US011181855B2

(12) United States Patent
Harada

(10) Patent No.: US 11,181,855 B2
(45) Date of Patent: Nov. 23, 2021

(54) FIXING DEVICE AND METHOD FOR CONTROLLING FIXING DEVICE

(71) Applicant: BROTHER KOGYO KABUSHIKI KAISHA, Nagoya (JP)

(72) Inventor: Yuya Harada, Anjo (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 16/950,474

(22) Filed: Nov. 17, 2020

(65) Prior Publication Data

US 2021/0149329 A1 May 20, 2021

(30) Foreign Application Priority Data

Nov. 19, 2019 (JP) ..... JP2019-208440
Jul. 1, 2020 (JP) ..... JP2020-113806

(51) Int. Cl.
*G03G 15/20* (2006.01)

(52) U.S. Cl.
CPC ..... *G03G 15/205* (2013.01); *G03G 15/2039* (2013.01); *G03G 15/2042* (2013.01)

(58) Field of Classification Search
CPC ..... G03G 15/2039; G03G 15/2042; G03G 15/2046; G03G 15/205
See application file for complete search history.

(56) References Cited

U.S. PATENT DOCUMENTS 6,008,829 A 12/1999 Wakamiya et al.
6,385,410 B1 * 5/2002 Hanyu ..... G03G 15/2064 399/337
9,501,005 B2 * 11/2016 Okamoto ..... G03G 15/2042
2006/0120745 A1 * 6/2006 Kinouchi ..... G03G 15/205 399/69
2013/0302058 A1 * 11/2013 Kimata ..... G03G 15/205 399/70
2014/0294419 A1 * 10/2014 Matsuno ..... G03G 15/2017 399/69
2014/0356037 A1 * 12/2014 Shimokawa ..... G03G 15/2053 399/329
2019/0072884 A1 * 3/2019 Sunohara ..... G03G 15/553
2019/0235423 A1 8/2019 Kato

FOREIGN PATENT DOCUMENTS

JP 9-305059 A 11/1997
JP 9-325644 A 12/1997
JP 2013-97027 A 5/2013
JP 2019-132998 A 8/2019

* cited by examiner

*Primary Examiner* — Carla J Therrien
(74) *Attorney, Agent, or Firm* — Merchant & Gould P.C.

(57) ABSTRACT

A fixing device includes a heating member, a first heater configured to heat a first area, a second heater configured to heat a second area, a first temperature detector, a second temperature detector, and a controller. The controller executes a heating control in which the first heater is energized based on the temperature of the first area so that the temperature of the first area is within a first temperature range and the second heater is energized based on the temperature of the second area so that the temperature of the second area is within a second temperature range. In the heating control, the controller executes (i) a first energizing processing, and (ii) a second energizing processing of energizing the second heater at the timing when the first energizing processing is stopped.

20 Claims, 11 Drawing Sheets

FIXING DEVICE AND METHOD FOR CONTROLLING FIXING DEVICE

The present application claims priority from Japanese Patent Application No. 2019-208440, which was filed on Nov. 19, 2019, and Japanese Patent Application No. 2020-113806, which was filed on Jul. 1, 2020, the disclosure of which is herein incorporated by reference in its entirety.

BACKGROUND

The following disclosure relates to a technique for fixing a developer on a sheet.

A fixing device configured to fix the developer with respect to the sheet is known. The fixing device includes a heating member for heating the sheet and a pressure member, sandwiching the sheet on which the developer is recorded between the heating member and the pressure member to thereby fix the developer on the sheet. There is a conventional fixing device including a plurality of temperature detectors configured to detect temperatures of the heating member, a plurality of heaters configured to heat the heating member, and a controller configured to control energization amounts of the respective heaters by using the temperatures detected by the respective detectors.

There is a case where voltage drop occurs in a power supply for supplying voltage to the heater due to rush current flowing in the heater when starting energization of the heater. In particular, it is concerned that voltage drop occurs every time when each of energizations of the heaters is started in the fixing device including the plurality of heaters.

SUMMARY

The present disclosure has been made in view of the above problems, an object thereof is to provide a fixing device and a method of controlling the fixing device capable of suppressing occurrence frequency of voltage drop caused by starting energizations of heaters.

A fixing device according to the present disclosure includes a heating member configured to heat a sheet, a first heater configured to heat a first area in the heating member, a second heater configured to heat a second area which is a different area from the first area in the heating member, a first temperature detector configured to detect a temperature of the first area, a second temperature detector configured to detect a temperature of the second area, and a controller. The controller executes a heating control in which the first heater is energized based on the temperature of the first area so that the temperature of the first area is within a first temperature range and the second heater is energized based on the temperature of the second area so that the temperature of the second area is within a second temperature range. In the heating control, the controller executes (i) a first energizing processing of energizing the first heater when the detected temperature of the first area is lower than a lower limit temperature in the first temperature range and the detected temperature of the second area is within the second temperature range, or when the detected temperature of the second area is lower than a lower limit temperature in the second temperature range and the detected temperature of the first area is within the first temperature range, and (ii) a second energizing processing of energizing the second heater at the timing when the first energizing processing is stopped.

In a method of controlling a fixing device according to the present disclosure, the fixing device includes a heating member configured to heat a sheet, a first heater configure to heat a first area in the heating member, and a second heater configured to heat a second area which is an area different from the first area in the heating member. The method includes a step of executing a heating control in which the first heater is energized based on a temperature of the first area so that the temperature of the first area is within a first temperature range and the second heater is energized based on a temperature of the second area so that the temperature of the second area is within a second temperature range. In the heating control, (i) a first energizing processing of energizing the first heater is executed when the detected temperature of the first area is lower than a lower limit temperature in the first temperature range and the detected temperature of the second area is within the second temperature range, or when the detected temperature of the second area is lower than a lower limit temperature in the second temperature range and the detected temperature of the first area is within the first temperature range, and (ii) the second energizing processing of energizing the second heater is executed at the timing when the first energizing processing is stopped.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

EMBODIMENT

A printer according to an embodiment will be explained with reference to the drawings. The printer is a laser printer configured to form an image on a sheet such as a recording paper or an OHP sheet by using developer of four colors, which are yellow, magenta, cyan, and black.

Figure 1:
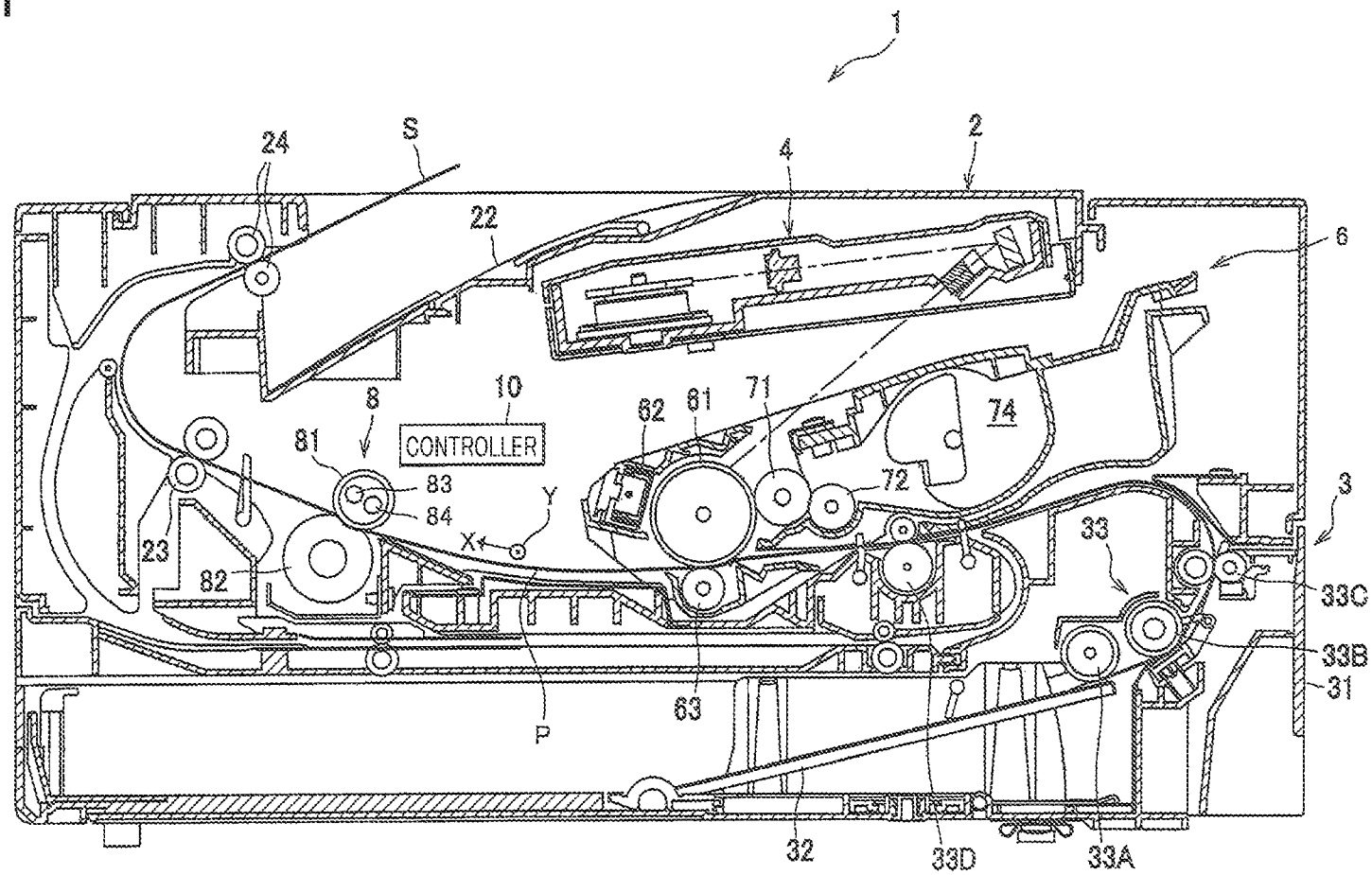
FIG. 1 is structural diagram of a printer.

As illustrated in FIG. 1, a printer 1 includes a sheet supplier 3, an exposing portion 4, a process unit 6, a fixing portion 8, a controller 10, and a housing 2 that stores the sheet supplier 3, the exposing portion 4, the process unit 6, the fixing portion 8, and the controller 10. In the embodiment, a fixing device is configured by the sheet supplier 3, the fixing portion 8, and the controller 10.

The sheet supplier 3 includes a supply tray 31 that stores a sheet S, a sheet pressing plate 32, and a supply mechanism 33. The supply mechanism 33 includes a pick-up roller 33A, a separating roller 33B, a first conveying roller 33C, and a registration roller 33D. In the sheet supplier 3, the sheet S in the supply tray 31 is attracted to the pick-up roller 33A by the sheet pressing plate 32, and fed to the separating roller 33B by the pick-up roller 33A. The sheet S is separated into one piece by the separating roller 33B and conveyed by the first conveying roller 33C. The registration roller 33D aligns a position of an end of the sheet S, thereafter conveying the sheet S toward the process unit 6.

The exposing portion 4 includes a not-illustrated laser light source, a polygon mirror, a lens, a reflective mirror, and so on illustrated without reference numerals. In the exposing portion 4, a surface of a later-described photoconductor drum 61 in the process unit 6 is scanned with laser light emitted from the laser light source based on image data, thereby forming an electrostatic latent image on the photoconductor drum 61.

The process unit 6 forms a developer image on the sheet S. The process unit 6 is disposed below the exposing portion 4 in the housing 2. The process unit 6 includes the photoconductor drum 61, a charging unit 62, a transfer roller 63, a developing roller 71, a supply roller 72, and a toner container 74 containing dry toner as a developer.

In the process unit 6, the surface of the photoconductor drum 61 is uniformly charged by the charging unit 62, then, the electrostatic latent image based on the image data is formed on the photoconductor drum 61 by the laser light emitted from the exposing portion. The toner in the toner container 74 is supplied to the developing roller 71 via the supply roller 72. The developing roller 71 supplies the toner to the photoconductor drum 61 on which the electrostatic latent image is formed. Accordingly, the electrostatic latent image is visualized and the developer image is formed on the photoconductor drum 61. After that, the sheet S supplied from the sheet supplier 3 is conveyed between the photoconductor drum 61 and the transfer roller 63, so that the developer image formed on the photoconductor drum 61 is transferred onto the sheet S.

The sheet S to which the developer image is transferred is conveyed to the fixing portion 8 by the photoconductor drum 61 and the transfer roller 63. The fixing portion 8 fixes the developer image on the sheet S conveyed from the process unit 6. The fixing portion 8 includes a heating member 81 configured to heat the sheet S and a pressure member 82 sandwiching the sheet S between the pressure member 82 and the heating member 81. The heating member 81 is a cylindrical-shaped roller held in the housing 2 so as to be rotatable. The pressure member 82 is a roller held in the housing 2 so as to be rotatable. When the sheet S to which the developer image is transferred is conveyed between the heating member 81 and the pressure member 82 in the fixing portion 8, the developer image is heat-fixed on the sheet S. The sheet S on which the developer image is heat-fixed is discharged onto an output tray 22 by a second conveying roller 23 and an output roller 24.

In the housing 2, a path of the sheet S from the supply tray 31 to the output tray 22 is referred to a conveying path P. A direction along a path of the conveying path P directed from the photoconductor drum 61 and the transfer roller 63 to the fixing portion 8 is referred to a conveying direction X. A direction, in directions intersecting the conveying direction X in the housing 2, parallel to a surface of the sheet S conveyed by the photoconductor drum 61 and the transfer roller 63 is referred to a width direction Y. In the embodiment, the photoconductor drum 61 and the transfer roller 63 correspond to an example of a conveyer.

Figure 2:
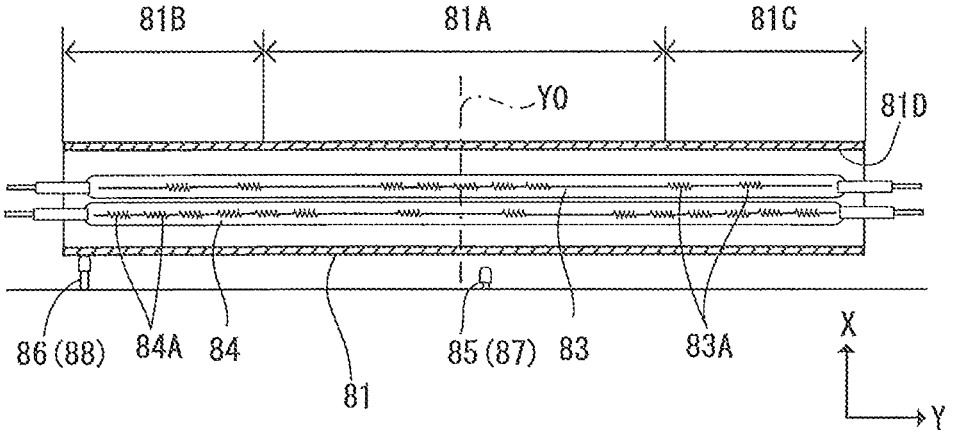
FIG. 2 is a view for explaining a first heater and a second heater.

FIG. 2 illustrates the inside of the heating member 81. In the housing 2, the heating member 81 is disposed so that a direction in which a rotation axis of the heating member 81 extends in the width direction Y On an outer circumferential surface with which the sheet S contacts in the heating member 81, an area respectively extending, from a center Y0 in the width direction Y, in one direction and the other direction in the width direction Y by a predetermined length is referred to a first area 81A. On the outer circumferential surface of the heating member 81, an area adjacent to one end of the first area 81A in the one direction of the width direction Y is referred to a second area 81B, and an area adjacent to the other end of the first area 81A in the other direction of the width direction Y is referred to a second area 81C. In the embodiment, a length dimension of the first area 81A in the width direction Y is longer than a length dimension of each of the second area 81B and the second area 81C. Length dimensions of the second area 81B and the second area 81C in the width direction Y are the same.

In a containing space 81D existing inside the heating member 81, a first heater 83 and a second heater 84 are disposed. The first heater 83 and the second heater 84 are halogen lamps in the embodiment. Each of the first heater 83 and the second heater 84 has a shape extending with approximately the same length dimension as a length dimension in the width direction Y of the heating member 81, and the first heater 83 and the second heater 84 are arranged side by side in the containing space 81D in the heating member 81. The first heater 83 includes a plurality of filaments 83A provided inside a glass tube. The second heater 84 includes a plurality of filaments 84A provided inside the glass tube.

The first heater 83 is a heater for heating the first area 81A of the heating member 81. In the first heater 83, the plurality of filaments 83A are disposed so that a density of the filaments 83A disposed at a part corresponding to the first area 81A of the heating member 81 is higher than a density of the filaments 83A disposed at each of parts corresponding to the second area 81B and the second area 81C. Accordingly, a heat amount of the first heater 83 given to the first area 81A in the heating member 81 is higher than a heat amount given to each of the second area 81B and the second area 81C. The second heater 84 is a heater for heating the second area 81B and the second area 81C of the heating member 81. In the second heater 84, the filaments 84A are disposed so that a density of the filaments 84A disposed at each of parts corresponding to the second area 81B and the second area 81C of the heating member 81 is higher than a density of the filaments 84A disposed at a part corresponding to the first area 81A. Accordingly, a heat amount of the second heater 84 given to each of the second area 81B and the second area 81C in the portion 81 is higher than a heat amount given to the first area 81A.

In the embodiment, power consumption of the first heater 83 is lower than power consumption of the second heater 84. Specifically, an impedance of the first heater 83 is a greater value than an impedance of the second heater 84 under the same temperature condition.

Figure 3:
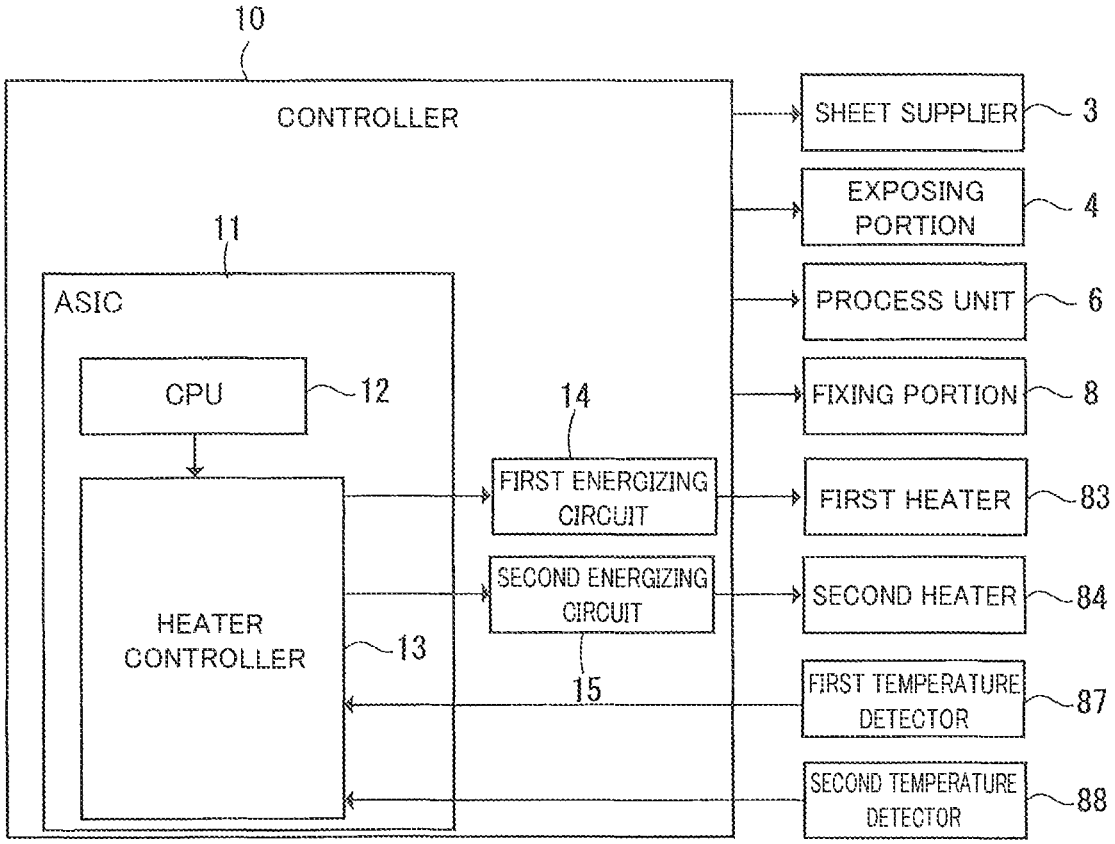
FIG. 3 is a functional block diagram of the printer.

As illustrated in FIGS. 2 and 3, in the housing 2, a first temperature detector 87 having a first temperature sensor 85 and a second temperature detector 88 having a second temperature sensor 86 are disposed close to the heating member 81. The first temperature sensor 85 is disposed close to the first area 81A of the heating member 81 in the housing 2, and the first temperature detector 87 is configured to detect a temperature of the first area 81A as a first detected temperature T1. The first temperature sensor 85 is a non-contact type sensor, which is disposed in the housing 2 so that a detection part is directed to the first area 81A of the heating member 81. The second temperature sensor 86 is disposed close to the second area 81B of the heating member 81 in the housing 2, and the second temperature detector 88 is configured to detect a temperature of the second area 81B as a second detected temperature T2. The second temperature sensor 86 is a contact-type sensor, which is disposed so that a detection part contacts the second area 81B of the heating member 81 in the housing 2. In the embodiment, the first temperature sensor is a thermistor using an infrared detection method and the second temperature sensor is a contact-type thermistor. Response speeds of the first temperature detector 87 and the second temperature detector 88 are affected by characteristics of the sensors and arrangements of detection positions. In the embodiment, the response speed of the first temperature detector is greater than the response speed of the second temperature detector.

As illustrated in FIG. 3, the controller 10 is connected to the sheet supplier 3, the exposing portion 4, the process unit 6, and the fixing portion 8, and controls each of drivings of the supplier 3, the exposing portion 4, the process unit 6 and the fixing portion 8. Specifically, the controller 10 controls motors for rotating respective rollers in the sheet supplier 3, controls motors for rotating the heating member 81 and the pressure member 82 in the fixing portion 8, and controls light emission of respective light sources in the process unit 6. The first temperature detector 87 and the second temperature detector 88 are connected to the controller 10, and the first detected temperature T1 detected by the first temperature detector 87 and the second detected temperature T2 detected by the second temperature detector 88 are repeatedly inputted at a predetermined cycle.

The controller 10 is connected to the first heater 83 and the second heater 84, and executes a heating control in which the temperature of the first area 81A, the temperature of the second area 81B and the second area 81C in the heating member 81 are controlled. Specifically, when executing a fixing processing for fixing the toner on the sheet S in a printing processing, the controller 10 controls the temperature of the first area 81A to be a first fixing temperature and controls the temperature of the second area 81B and the second area 81C to be a second fixing temperature lower than the first fixing temperature. On the other hand, in a standby mode in which the printer 1 does not execute the printing processing, the controller 10 controls the temperature of the first area 81A to be a temperature lower than the first fixing temperature and controls the temperature of the second area 81B and the second area 81C to be a temperature lower than the second fixing temperature.

The controller 10 includes an ASIC 11, a first energizing circuit 14, and a second energizing circuit 15. The first energizing circuit 14 includes a TRIAC as a switching element, and switches between an energized state in which AC voltage supplied from not-illustrated AC power is supplied to the first heater 83 and a non-energized state in which AC voltage is not supplied to the first heater 83. The second energizing circuit 15 includes a TRIAC as a switching element, and switches between an energized state in which AC voltage supplied from not-illustrated AC power is supplied to the second heater 84 and a non-energized state in which AC voltage is not supplied to the second heater 84. The higher a duty ratio of the TRIAC becomes, the higher energization rates of the first heater 83 and the second heater 84 become, therefore, outputs of the first heater 83 and the second heater 84 are increased. On the other hand, the lower the duty ratio of the TRIAC becomes, the lower the energization rates of the first heater 83 and the second heater 84 become, therefore, the outputs of the first heater 83 and the second heater 84 are reduced.

The ASIC 11 includes a CPU 12 and a heater controller 13. In the heating control, the ASIC 11 executes a first energizing processing in which the duty ratio in energization of the first heater 83 is adjusted and a second energizing processing in which the duty ratio in energization of the second heater 84 is adjusted. The CPU 12 outputs a target temperature of the first area 81A in the heating member 81 and a target temperature of the second area 81B and the second area 81C to the heater controller 13.

The heater controller 13 executes, as the first energizing processing, a feedback control in which a first drive signal of the first energizing circuit 14 is a manipulated variable so that the first detected temperature T1 detected by the first temperature detector 87 comes close to the target temperature. The heater controller 13 executes, as the second energizing processing, a feedback control in which a second drive signal of the second energizing circuit 15 is a manipulated variable so that the second detected temperature T2 detected by the second temperature detector 88 comes close to the target temperature. The first drive signal is a signal for on-off operating the TRIAC of the first energizing circuit 14. The second drive signal is a signal for on-off operating the TRIAC of the second energizing circuit 15.

In the printer 1 having the above configuration, there is a case where voltage drop occurs due to rush current flowing in the first heater 83 and the second heater 84 when starting energization of the first heater 83 and the second heater 84. In particular, it is concerned that voltage drop occurs every time each of energizations of the first heater 83 and the second heater 84 is started in a case where the first heater 83 and the second heater 84 are independently controlled in accordance with the first detected temperature T1 and the second detected temperature T2. In view of the above, in the embodiment, the controller 10 determines whether the temperature of the first area 81A or the temperature of the second area 81B and the second area 81C in the heating member 81 is lower than a temperature necessary to be heated by the heater or not. When it is determined that the temperature of the first area 81A or the temperature of the second area 81B is lower than the temperature necessary to be heated by the heater, the controller 10 increases the temperature of the heating member 81 by executing the first energizing processing with respect to the first heater 83. After that, the controller 10 executes the second energizing processing with respect to the second heater 84 at the timing when the first energizing processing is stopped.

Figure 4:
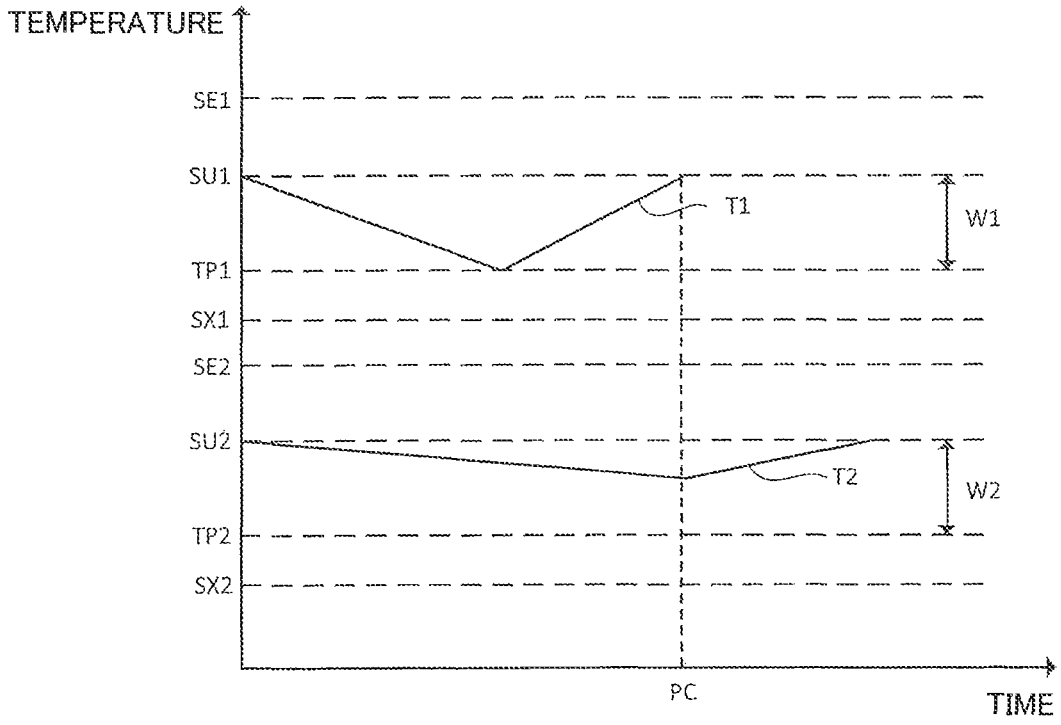
FIG. 4 is a chart for explaining temperatures in a first area and a second area.

Next, temperatures of the first area 81A, the second area 81B and the second area 81C controlled by the first energizing processing and the second energizing processing will be explained with reference to FIG. 4. In FIG. 4, a first target temperature TP1 is a target temperature of the first area 81A in the standby mode of the printer 1. A second target temperature TP2 is a target temperature of the second area 81B and the second area 81C in the standby mode of the printer 1. The first target temperature TP1 is set to a higher value than the second target temperature TP2. A timing PC indicates a timing when the second energizing processing is stated after the first energizing processing is stopped.

The controller 10 controls the temperature of the first area 81A to be within a first temperature range W1 by the heating control. The first temperature range W1 is prescribed as a temperature range sandwiched between a first upper limit temperature SU1 as an upper limit temperature and the first target temperature TP1 as a lower limit temperature. In the embodiment, the first upper limit temperature SU1 is a temperature obtained by adding a predetermined temperature width to the first target temperature TP1. The controller 10 controls the temperature of the second area 81B and the second area 81C to be within a second temperature range W2 by the heating control. The second temperature range W2 is a temperature range sandwiched between a second upper limit temperature SU2 as an upper limit temperature and the second target temperature TP2 as a lower limit temperature. In the embodiment, the second upper limit temperature SU2 is a temperature obtained by adding a predetermined temperature width to the second target temperature TP2, and the second upper limit temperature SU2 is set to a lower value than the first target temperature TP1.

The first temperature range W1 is a temperature range lower than the first fixing temperature, and the second temperature range W2 is a temperature range lower than the second fixing temperature in the embodiment. A first overshoot temperature SE1 is a temperature higher than the first upper limit temperature SU1. The first overshoot temperature SE1 is a temperature in which, when the temperature of the first area 81A is increased up to the first overshoot temperature SE1, temperature variation in the first area 81A will be excessive. A second overshoot temperature SE2 is a temperature in which, when the temperature of the second area 81B and the second area 81C are increased up to the second overshoot temperature SE2, temperature variations in the second area 81B and the second area 81C will be excessive. The second overshoot temperature SE2 is set to be higher than the second upper limit temperature SU2 and lower than the first target temperature TP1. A second undershoot temperature SX2 is a temperature lower than the second target temperature TP2. A first undershoot temperature SX1 is a temperature lower than the first target temperature TP1. In the embodiment, the first undershoot temperature SX1 is set to be higher than the second overshoot temperature SE2. Note that the first undershoot temperature SX1 may be set to be lower than the second overshoot temperature SE2.

Figure 5:
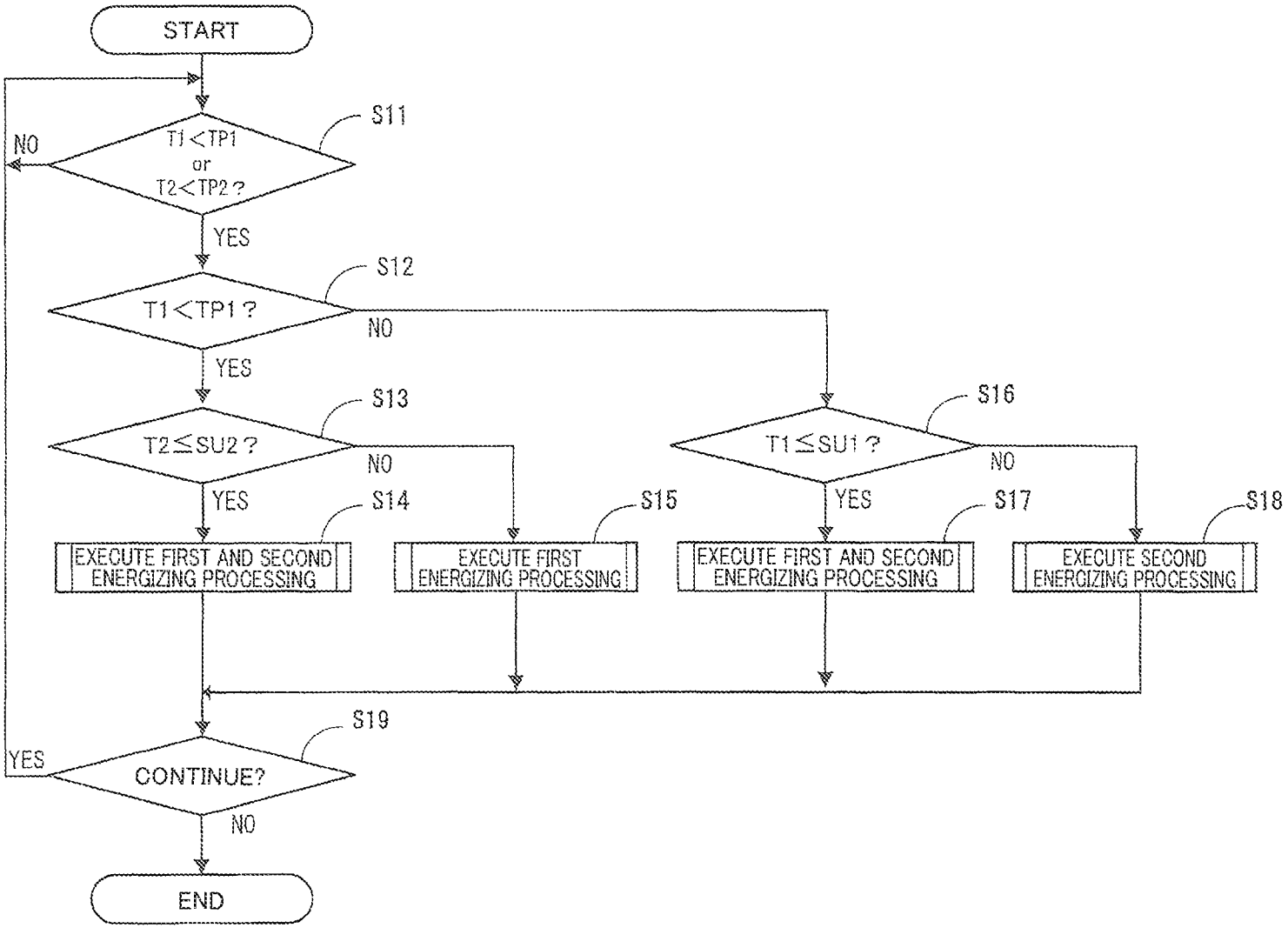
FIG. 5 is a flowchart illustrating a procedure of a heating control.

Next, a flowchart of the heating control will be explained with reference to FIG. 5. A processing illustrated in FIG. 5 is executed by the controller 10 in the case where the printer 1 is in the standby mode.

At Step S11, the controller 10 determines whether the first detected temperature T1 is lower than the first target temperature TP1 or not, or whether the second detected temperature T2 is lower than the second target temperature TP2 or not. When it is determined that the first detected temperature T1 is lower than the first target temperature TP1 or that the second detected temperature T2 is lower than the second target temperature TP2, the flow proceeds to Step S12. When it is negatively determined at S11, the flow starts to wait.

At Step S12, when it is determined that the first detected temperature T1 is lower than the first target temperature TP1, the flow proceeds to Step S13, and the controller 10 determines whether the second detected temperature T2 is equal to or lower than the second upper limit temperature SU2 or not. When it is determined that the second detected temperature T2 is equal to or lower than the second upper limit temperature SU2 at Step S13, the flow proceeds to Step S14, where the heater controller 13 executes the first energizing processing with respect to the first heater 83 and the second energizing processing with respect to the second heater 84.

Figure 6:
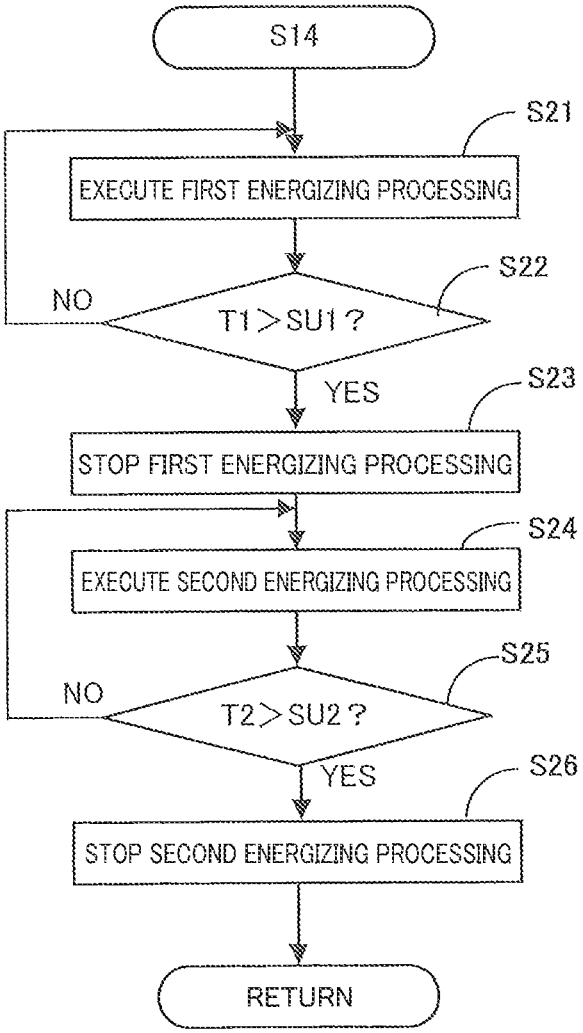
FIG. 6 is a flowchart illustrating the detailed processing at Step S14.

FIG. 6 is a flowchart illustrating a processing executed at Step S14 in detail. At Step S21, the heater controller 13 executes the first energizing processing with respect to the first heater 83. This is for suppressing rush current at the time of starting energization of the second heater 84 by heating the second heater 84 by the output from the first heater 83 with lower power consumption to thereby increase the impedance of the second heater 84.

Here, it is possible to energize the first energizing circuit 14 by a phase control when executing the first energizing processing. Specifically, the heater controller 13 is allowed to output the first drive signal to the first energizing circuit 14 so that the TRIAC of the first energizing circuit 14 is on-off operated at a duty ratio less than 50% by the phase control. More specifically, a firing angle of the TRIAC is increased to be larger than 90 degrees and 270 degrees so as not to operate the TRIAC to be on at the peak timing of AC voltage. Note that, when a predetermined period of time has passed from the start of energization of the first heater 83, a wave number control in which energization is controlled in a half-wave unit of AC voltage may be executed, or the phase control may be executed at a duty ratio in the vicinity of 100% by on operation.

At Step S22, the controller 10 determines whether the first detected temperature T1 exceeds the first upper limit temperature SU1 or not. When it is determined that the first detected temperature T1 is equal to or lower than the first upper limit temperature SUL the flow returns to Step S21 and the first energizing processing with respect to the first heater 83 is continued. On the other hand, it is positively determined at Step S22, the flow proceeds to Step S23, where the first energizing processing with respect to the first heater 83 is stopped.

At Step S24, the heat controller 13 starts the second energizing processing with respect to the second heater 84. Specifically, the second energizing processing is started at the timing when the first energizing processing is stopped. In the chart illustrated in FIG. 4, at the Timing PC when the first detected temperature T1 exceeds the first upper limit temperature SUL the first energizing processing is stopped and the second energizing processing is started. After the Timing PC, the second detected temperature T2 increases. Accordingly, the first energizing processing and the second energizing processing can be successively executed. That is, since energization to the first heater 83 and energization to the second heater 84 are successively executed, occurrence of rush current at the time of starting energization of the second heater 84 is suppressed, and occurrence frequency of voltage drop is suppressed.

At Step S25, the controller 10 determines whether the second detected temperature T2 exceeds the second upper limit temperature SU2 or not. When it is determined that the second detected temperature T2 is equal to or lower than the second upper limit temperature SU2, the flow returns to Step S24, and the second energizing processing with respect to the second heater 84 is continued. When it is determined that the second detected temperature T2 exceeds the second upper limit temperature at Step S25, the flow proceeds to Step S26, where the second energizing processing by the heater controller 13 is stopped.

Returning to FIG. 5, when it is determined the second detected temperature T2 exceeds the second upper limit temperature SU2 at Step S13, the flow proceeds to Step S15, where the heat controller 13 executes only the first energizing processing with respect to the first heater 83. If the second energizing processing is executed in a state in which the temperature of the second area 81B and the second area 81C exceeds the second upper limit temperature SU2, it is concerned that the temperature of the second area 81B and the second area 81C becomes too high. This is for preventing the temperature of the second area 81B and the second area 81C from becoming too high without executing the second energizing processing.

Figure 7:
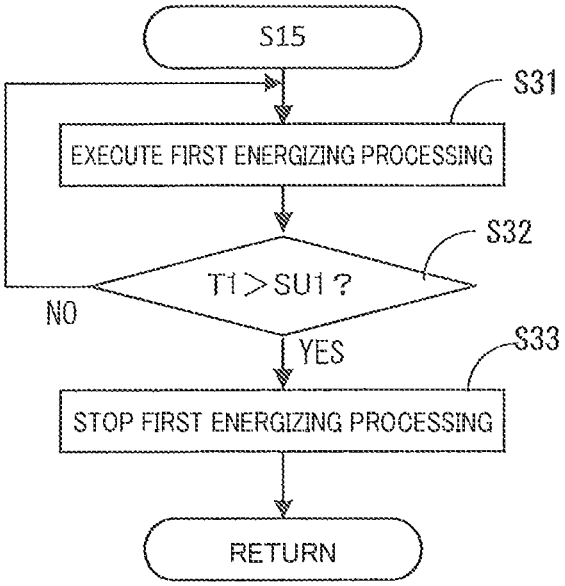
FIG. 7 is a flowchart illustrating the detailed processing at Step S15.

FIG. 7 is a flowchart illustrating a processing executed at Step S15 in detail. At Step S31, the heat controller 13 executes the first energizing processing with respect to the first heater 83. At Step S32, the controller 10 determines whether the first detected temperature T1 exceeds the first upper limit temperature SU1 or not. When it is determined that the first detected temperature T1 is equal to or lower than the first upper limit temperature SUL the flow returns to Step S31, and the first energizing processing is continued. That is, the temperature of the first area 81A is increased up to the first upper limit temperature SUL On the other hand, when it is determined that the first detected temperature T1 exceeds the first upper limit temperature SUL the flow proceeds to Step S33, where the first energizing processing with respect to the first heater 83 is stopped by the heater controller 13.

Returning to FIG. 5, the controller 10 determines whether the standby mode of the printer 1 is continued or not at Step S19. When it is determined that the standby mode is continued, the flow returns to Step S11.

When it is determined that the first detected temperature T1 is not lower than the first target temperature TP1 at Step S12, that is, when it is determined that the second detected temperature T2 is lower than the second target temperature TP2, the flow proceeds to Step 516. At Step S16, the controller 10 determines whether the first detected temperature T1 is equal to or lower than the first upper limit temperature SU1 or not. When it is determined that the first detected temperature T1 is equal to or lower than the first upper limit temperature SU1 at Step S16, the flow proceeds to Step S17, where the first energizing processing and the second energizing processing are executed in this order. Since the detailed processing at Step S17 is the same as the processing at Step S14, explanation thereof is omitted.

When it is determined that the first detected temperature T1 exceeds the first upper limit temperature SU1 at Step S16, the flow proceeds to Step S18, where the heat controller 13 executes only the second energizing processing. If the first energizing processing is executed in a state in which the temperature of the first area 81A exceeds the first upper limit temperature SU1, it is concerned that the temperature of the first area 81A becomes too high. This is for preventing the temperature of the first area 81A from becoming too high without executing the first energizing processing.

The detailed processing at Step S18 will be explained by referring FIG. 7. First, the heat controller 13 executes the second energizing processing with respect to the second heater 84 (Step S31 in FIG. 7). The controller 10 determines whether the second detected temperature T2 exceeds the second upper limit temperature SU2 or not, and when it is determined that the second detected temperature T2 is equal to or lower than the second upper limit temperature SU2 (NO at Step S32 in FIG. 7), the second energizing processing is continued. On the other hand, when it is determined that the second detected temperature T2 exceeds the second upper limit temperature SU2 (YES at Step S32 in FIG. 7), the second energizing processing by the heater controller 13 is stopped (Step S33 in FIG. 7).

Returning to FIG. 5, when it is determined that the standby mode of the printer 1 is ended at Step S19, the processing in FIG. 5 is ended once.

In the embodiment explained above, the following advantages can be obtained. The controller 10 executes the heating control so that the temperature of the first area 81A is within the predetermined first temperature range W1 and so that the temperature of the second area 81B and the second area 81C is within the predetermined second temperature range W2 by energizing the first heater 83 and the second heater 84 based on the temperatures of the first area 81A, the temperature of the second area 81B and the second area 81C. The controller 10 executes the first energizing processing in which the first heater 83 is energized when the temperature of the first area 81A is lower than the lower limit value of the first temperature range W1 as well as the temperature of the second area 81B and the second area 81C is within the second temperature range W2, or when the temperature of the second area 81B and the second area 81C is lower than the lower limit value of the second temperature range W2 as well as the temperature of the first area 81A is within the first temperature range W1 in the heating control. The controller 10 executes the second energizing processing in which the second heater 84 is energized at the timing when the first energizing processing is stopped. Accordingly, energization to the first heater 83 and the energization to the second heater 84 are successively executed, thereby suppressing occurrence of rush current at the time of staring energizing the second heater 84 as compared with a case where the energizations to the first heater 83 and the second heater 84 are independently controlled based on the respective detected temperature T1 and detected temperature T2, and eventually, occurrence frequency of voltage drop can be suppressed. That is, occurrence frequency of voltage drop can be suppressed by suppressing increase of apparent frequency of energization with respect to the first heater 83 and the second heater 84.

The controller 10 executes only the first energizing processing in which the first heater 83 is energized when the first detected temperature T1 is lower than the first temperature range W1 as well as the second detected temperature T2 is higher than the second temperature range W2. The controller 10 also executes only the second energizing processing in which the second heater 84 is energized when the second detected temperature T2 is lower than the second temperature range W2 as well as the first detected temperature T1 is higher than the first temperature range W1. According to the control, it is possible to inhibit the temperatures of the first area 81A, the second area 81B and the second area 81C from being increased too much.

The controller 10 increases the temperature of the second heater 84 by heat from the first heater 83 with low power consumption in the first energizing processing, and starts energization of the second heater 84 with higher power consumption than the first heater 83 after increasing internal resistance of the second heater 84. Accordingly, occurrence frequency of voltage drop due to the energization of the second heater can be further suppressed.

The controller 10 executes the phase control of current flowing in the first heater 83 under a condition in which an energization ratio is less than 50% in the first energizing processing. The upper limit value of current flowing in the first heater 83 can be limited by the above control, therefore, occurrence frequency of voltage drop at the time of starting energization of the first heater 83 can be suppressed.

The printer 1 includes the sheet supplier 3 configured to convey the sheet S toward the heating member 81 in the predetermined conveying direction X. The first area 81A in the heating member 81 is a central part in the width direction Y as a direction intersecting the conveying direction X on the outer circumferential surface of the heating member 81, and the second area 81B and the second area 81C are areas positioned at each of the ends of the first area 81A in the width direction Y on the surface of the heating member 81. Accordingly, frequency of energization can be reduced even in the configuration in which the plurality of heaters are arranged in accordance with the width of the sheet S, and eventually, occurrence frequency of voltage drop at the time of energization can be suppressed.

The lower the temperatures of the first heater 83 and the second heater 84 are, the lower the impedances of the first heater 83 and the second heater 84 become, therefore, it is concerned that voltage drop easily occurs at the time of starting energization of the first heater 83 and the second heater 84. In the embodiment, the controller 10 controls the first area 81A to be the first fixing temperature and controls the second areas 81B to be the second fixing temperature when the fixing processing for fixing the toner onto the sheet S is executed. The first temperature range W1 covers a lower temperature range than the first fixing temperature, and the second temperature range W2 covers a lower temperature range than the second fixing temperature. Accordingly, occurrence frequency of voltage drop can be suppressed in a case in which intermittent energization is necessary such as the standby mode of the printer 1.

The response speed of the first temperature detector 87 is greater than the response speed of the second temperature detector 88. Accordingly, the heat controller 13 can energize the first heater 83 corresponding to the first temperature detector 87 with the higher priority than the second heater 84, resulting in quick increase of the temperature of the second heater 84. As a result, occurrence frequency of voltage drop due to the energization of the second heater 84 can be further suppressed

Second Embodiment

In a second embodiment, configurations different from the first embodiment will be mainly explained. Components to which the same signs are given in the first embodiment and the second embodiment are the same components and the explanation is not repeated.

Figure 8:
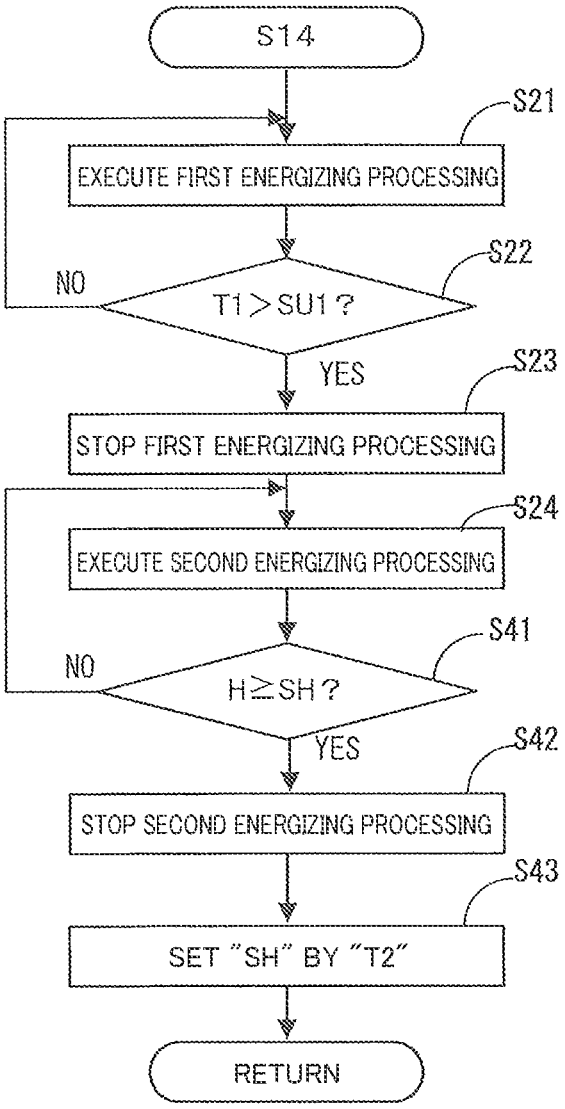
FIG. 8 is a flowchart illustrating the detailed processing at Step S14 according to a second embodiment.

In the embodiment, the controller 10 executes a time determination processing in which an energization period of the second heater 84 in the second energizing processing is determined by time. FIG. 8 is a flowchart indicating the detailed processing executed at Step S14 in FIG. 5 in the embodiment.

When it is determined that the first detected temperature T1 exceeds the first upper limit temperature SU1 at Step S22 after the first energizing processing with respect to the first heater 83 is started at Step S21, the first energizing processing with respect to the first heater 83 is stopped at Step S23.

At Step S24, the heat controller 13 executes the second energizing processing with respect to the second heater 84. The controller 10 determines whether that an energization period H of the second heater 84 by the second energizing processing is equal to or greater than an energization period determination value SH or not at Step S41. The energization period determination value SH is a value for determining a length of time of energization of the heater 84 after the energization to the second heater 84 is started.

When it is determined that the energization period H is shorter than the energization period determination value SH at Step S41, the flow returns to Step S24, and the second energizing processing is continued. On the other hand, when it is determined that the energization period H is equal to or greater than the energization period determination value SH, the flow proceeds to Step S42. At Step S42, the second energizing processing is stopped.

At Step S43, the controller 10 sets the energization period determination value SH by using a current second detected temperature T2 detected by the second temperature detector 88. When the current second detected temperature T2 largely exceeds the second upper limit temperature SU2, it can be said that the energization period of the second heater 84 by the second energizing processing is too long. On the other hand, when the current second detected temperature T2 is largely lower than the second upper limit temperature SU2, it can be said that the energization period of the second heater 84 by the second energizing processing is too short. Accordingly, in the embodiment, the controller 10 changes the energization period determination value SH used for determination at Step S41 to a reduced value when the current second detected temperature T2 largely exceeds the second upper limit temperature SU2, and changes the energization period determination value SH to an increased value when the current second detected temperature T2 is largely lower than the second upper limit temperature SU2.

For example, the controller 10 stores a period correction value table recording correspondence relationships between temperature differences AT2 between the second detected temperatures T2 and the second upper limit temperature SU2 and correction values for changing the energization period determination value SH to the reduced value or the increased value. At Step S43, the controller 10 reads a correction value corresponding to the temperature difference AT2 from the period correction value table to thereby change the energization period determination value SH by using the read correction value.

After that, at the processing at Step S41 of next time, the energization period of the second heater 84 is determined by using the energization period determination value SH changed at Step S43.

In the above explained embodiment, the following advantages can be obtained. The controller 10 stops energization of the second heater 84 after energizing the second heater 84 only for the predetermined energization period H in the second energizing processing. The controller 10 changes the energization period in a current second energizing processing based on the second detected temperature T2 detected after execution of a previous second energizing processing. Accordingly, the energization period H in the second energizing processing can be a proper value without excess and deficiency.

Third Embodiment

In a third embodiment, configurations different from the first embodiment will be mainly explained. Components to which the same signs are given in the first embodiment and the third embodiment are the same components and the explanation is not repeated.

In the embodiment, a length of the energization period of the second heater 84 in the second energizing processing is switched between the temperature determination processing in which determination is made by temperature and the time determination processing in which determination is made by time. There is a case where the second detected temperature T2 is continued to increase when an increasing speed of the temperature of the second area 81B and the second area 81C due to the heating by the second heater 84 is high. Therefore, energization of the second heater 84 is changed from the temperature determination processing to the time determination processing so as to cope with the above case in the embodiment.

Figure 9:
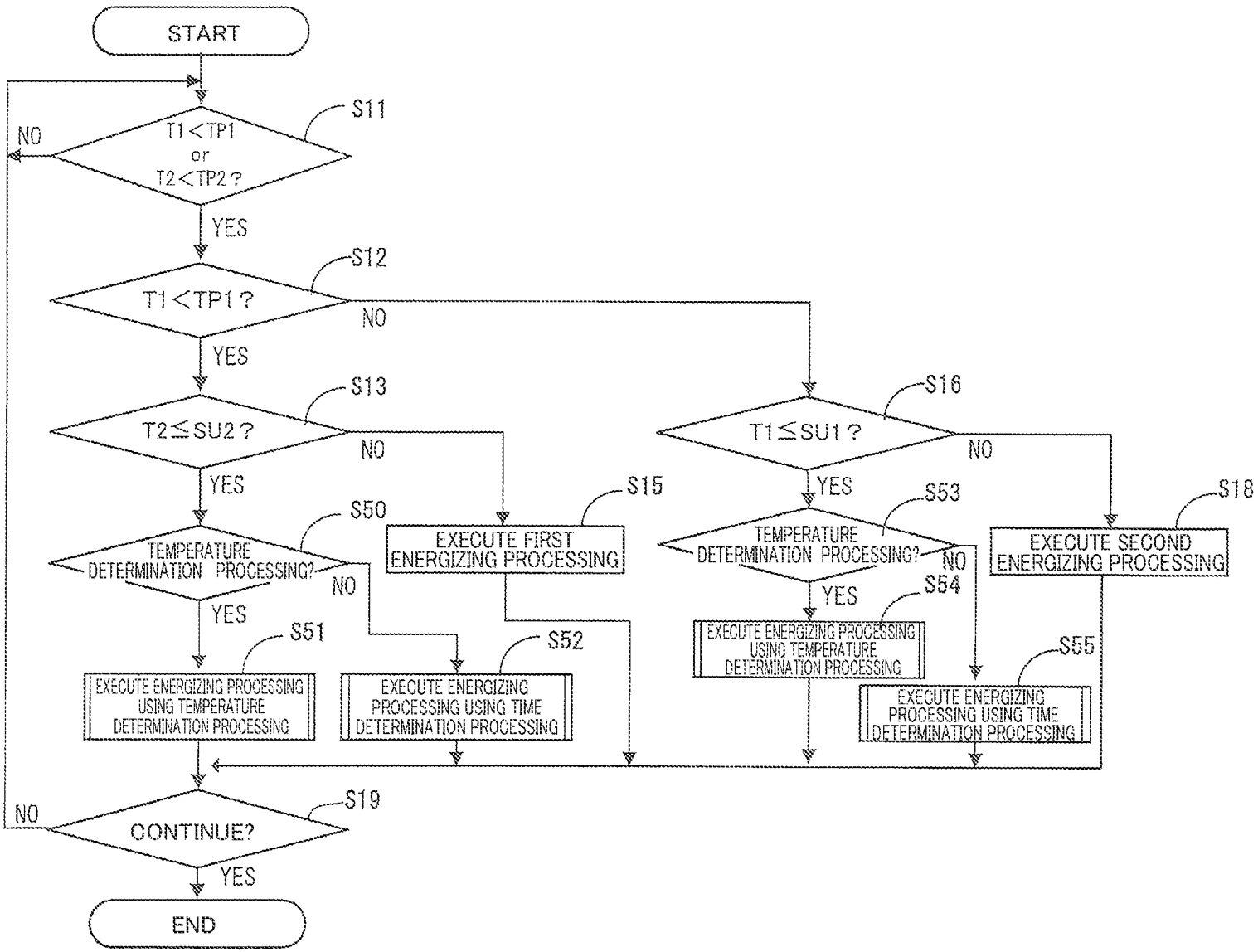
FIG. 9 is a flowchart for explaining a procedure of a heating control according to a third embodiment.

A procedure of the heating control according to the embodiment will be explained with reference to FIG. 9. The processing illustrated in FIG. 9 is processing executed by the controller 10 when the printer 1 is in the standby mode.

When it is determined that the second detected temperature T2 is equal to or lower than the second upper limit temperature SU2 at Step S13, the flow proceeds to Step S50. At Step S50, the controller 10 determines whether the energization period of the second heater 84 is presently determined by the temperature determination processing or not. In the embodiment, the temperature determination processing is selected as a control for the energization period of the second heater 84 at the time of power activation of the printer 1. When it is positively determined at Step S50, the flow proceeds to Step S51.

Figure 10:
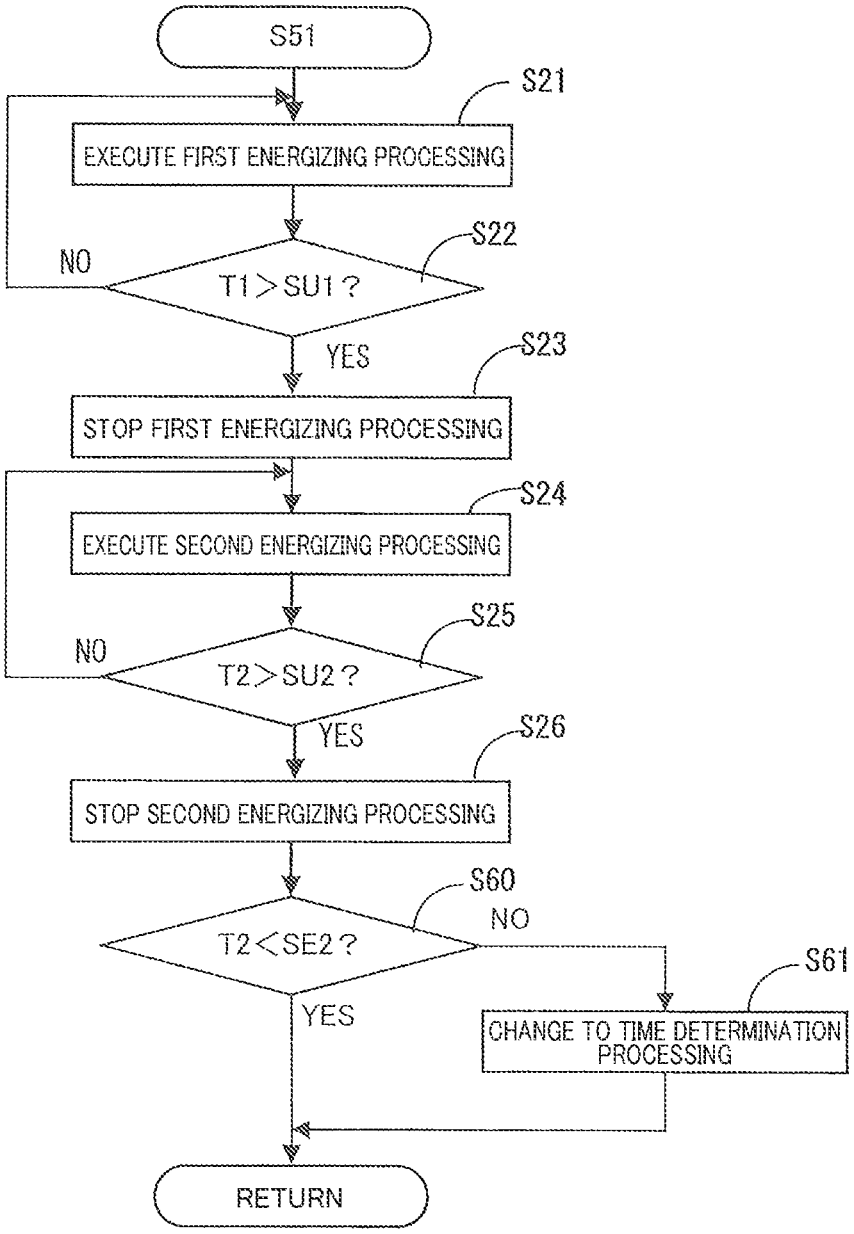
FIG. 10 is a flowchart illustrating the detailed processing at Step S51.

FIG. 10 is a flowchart for explaining the detailed processing of Step S51. In respective steps illustrated in FIG. 10, the same step numbers are given to the same processing as in the steps illustrated in FIG. 6. That is, the first energizing processing is executed to the first heater 83 at Steps S21, S22, and S23 also in the embodiment. The second energizing processing is executed to the second heater 84 in the subsequent Steps S24, S25, and S26. Specifically, energization to the second heater 84 by the second energizing circuit 15 at Step S24 is continued until it is determined, as the temperature determination processing, that the second detected temperature T2 exceeds the second upper limit temperature SU2 at Step S25.

After the energization of the second heater 84 is stopped at Step S26, the controller 10 determines whether the current second detected temperature T2 detected by the second temperature detector 88 is lower than the second overshoot temperature SE2 or not at Step S60. As illustrated in FIG. 4, the second overshoot temperature SE2 is a temperature higher than the second upper limit temperature SU2.

When it is determined that the current second detected temperature T2 is lower than the second overshoot temperature SE2 at Step S60, the flow returns to FIG. 9 and proceeds to Step S19. On the other hand, when it is determined that the current second detected temperature T2 is equal to or higher than the second overshoot temperature SE2, the flow proceeds to Step S61, and determination for the energization period of the second heater 84 is changed to the time determination processing. Then, the flow returns to FIG. 9 and proceeds to Step S19.

Figure 11:
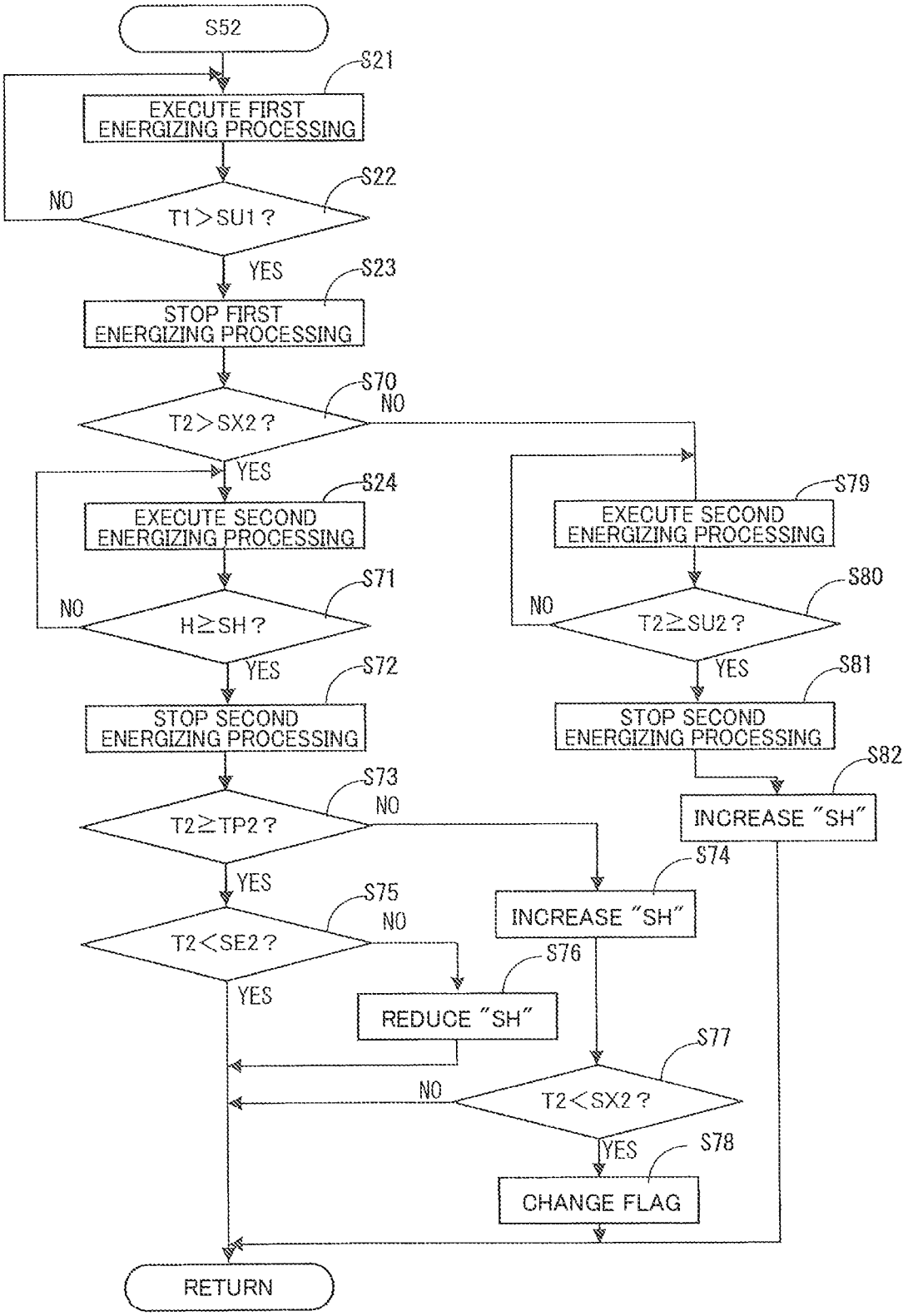
FIG. 11 is a flowchart illustrating the detailed processing at Step S52.

When the determination for the energization period of the second heater 84 has been changed to the time determination processing at Step S50 in FIG. 9, the flow proceeds to Step S52. FIG. 11 is a flowchart for explaining the detailed processing of Step S52. Also at Step S52, the first energizing processing to the first heater 83 is executed at Steps S21, S22, and S23.

After the first energizing processing is stopped at Step S23, the flow proceeds to Step S70. At Step S70, the controller 10 determines whether the second detected temperature T2 detected after the execution of the previous second energizing processing is equal to or higher than the second undershoot temperature SX2 or not. In the embodiment, it is determined that the second detected temperature T2 detected after the execution of the previous second energizing processing is equal to or higher than the second undershoot temperature SX2 or not in accordance with a value of a later described a determination flag set at Step S78. Note that when the second detected temperature T2 detected after the execution of the previous second energizing processing has not been detected, or when it is determined that the second detected temperature T2 detected after the execution of the previous second energizing processing is equal to or higher than the second undershoot temperature SX2, it is positively determined at Step 70, and the flow proceeds to Step S24.

After the energization of the second heater 84 is started at Step S24, the controller 10 determines whether the energization period H is equal to or greater than the energization period determination value SH at Step S71. That is, the energization period of the second heater 84 is determined by the time determination processing first in the second energizing processing. When it is determined that the energization period H is shorter than the energization period determination value SH, the flow returns to Step S24, and the second energizing processing is continued. When the energization period H is equal to or greater than the energization period determination value SH, the flow proceeds to Step S72. At Step S72, the second energizing processing with respect to the second heater 84 is stopped.

At Step S73, the controller 10 determines whether the current second detected temperature T2 detected by the second temperature detector 88 is equal to or higher than the second target temperature TP2 or not. When it is determined that the second detected temperature T2 is lower than the second target temperature TP2, the flow proceeds to Step S74, and the energization period determination value SH is changed to the increased value. The flow proceeds to Step S77, where the controller 10 determines whether the second detected temperature T2 detected after the execution of the second energizing processing, that is a current second detected temperature T2, is lower than the second undershoot temperature SX2 or not. When it is determined that the current second detected temperature T2 is equal to or higher than the second undershoot temperature SX2, and it is negatively determined at Step S77, the processing in FIG. 11 is ended once, and the flow proceeds to Step S19 (FIG. 9). On the other hand, when it is determined that the current second detected temperature T2 is lower than the second undershoot temperature SX2, and, it is positively determined at Step S77, the flow proceeds to Step S78. At Step S78, the controller 10 changes the determination flag to a value indicating that the second detected temperature T2 detected after the execution of the second energizing processing has become lower than the second undershoot temperature SX2. The determination flag is used in the determination at Step S70. After that, the processing in FIG. 11 is ended once, and the flow proceeds to Step 19 (FIG. 9).

Returning to Step S73, when it is determined that the second detected temperature T2 is equal to or higher than the second target temperature TP2, the flow proceeds to Step S75, where the controller 10 determines whether the current second detected temperature T2 is lower than the second overshoot temperature SE2 or not. When it is determined that the current second detected temperature T2 is equal to or higher than the second overshoot temperature SE2, the flow proceeds to Step S76, and the energization period determination value SH is changed to the reduced value.

In the next processing, the flow proceeds to Step S70, and when it is determined that the second detected temperature T2 detected after the execution of the previous second energizing processing is lower than the second undershoot temperature SX2, the flow proceeds to Strep S79. At Step S79, the second energizing processing is started. At Step S80, the controller 10 determines whether the second detected temperature T2 is equal to or higher than the second upper limit temperature SU2 or not. That is, when the second detected temperature T2 detected after the execution of the previous second energizing processing is lower than the second undershoot temperature SX2, ending-determination for the energization period in the second energizing is changed from the time determination processing to the temperature determination processing. Accordingly, in a condition that the second detected temperature T2 is equal to or higher than the second upper limit temperature SU2, the second energizing processing to the second heater 84 is stopped. When it is negatively determined at Step S80, the flow returns to the Step S79 and the second energizing processing is continued. On the other hand, when it is positively determined at Step S80, the flow proceeds to Step S81, and the second energizing processing is stopped.

At the Step S82, the controller 10 changes the energization period determination value SH to the increased value. This is for extending the energizing period in the second energizing processing, since the second detected temperature T2 detected after the execution of the second energizing processing is lower than the second undershoot temperature SX2. After the processing of Step S82 is completed, the processing in FIG. 11 is ended once, and the flow proceeds to Step S19 (FIG. 9).

When it is determined that the first detected temperature T1 is not lower than the first target temperature TP1 at Step S12 in FIG. 9, that is, the second detected temperature T2 is lower than the second target temperature TP2, the flow proceeds to Step S16, and the controller 10 determines whether the first detected temperature T1 is equal to or lower than the first upper limit temperature SU1 or not. When it is positively determined at the Step S16, the flow proceeds to Step S53, and the controller 10 determines whether the energization period of the second heater 84 is determined by the temperature determination processing or not.

When it is positively determined at the Step S53, the heat controller 13 executes the first energizing processing to the first heater 83 and the second energizing processing to the second heater 84 by using the temperature determination processing at Step S54. The processing executed at Step S54 is the same processing as the processing illustrated in FIG. 10 in detail. That is, the energization period of the second heater 84 is determined by the temperature determination processing.

On the other hand, when it is negatively determined at the Step S53, the heat controller 13 executes the first energizing processing to the first heater 83 and the second energizing processing to the second heater 84 by using the time determination processing at Step S55. The processing executed at Step S55 is the same processing as the processing illustrated in FIG. 11 in detail. That is, the energization period of the second heater 84 is determined by the time determination processing.

In the above explained embodiment, the following advantages can be obtained. In the case where the second detected temperature T2 detected after the execution of the previous second energizing processing of is higher than the second overshoot temperature SE2 which is a higher temperature than the second upper limit temperature SU2, the controller 10 determines the energization period of the second heater 84 by time in the second energizing processing of next time. Accordingly, for example, it is possible to inhibit the temperature of the second area 81B and the second area 81C from continuing to increase to a high temperature.

The controller 10 stops the second energizing processing to the second heater 84 when the second detected temperature T2 detected after the execution of the previous second energizing processing is lower than the second undershoot temperature SX2 in a condition that the second detected temperature T2 detected in the current second energizing processing is equal to or higher than the second upper limit temperature SU2. Accordingly, in a case in which the ending-determination for the energizing period in the second energizing processing is determined by the time determination processing and when the heat amount given to the second heater 84 is not enough, the ending-determination for the energizing period is changed to the temperature determination processing. Accordingly, it is possible to increase the temperature of the second heater 84 to the target temperature without excess and deficiency

Other Embodiments

The technique disclosed in the specification is not limited to the above embodiments and may be modified in various manners within a scope not departing from the gist thereof. For example, the following modifications may occur.

In the above explained embodiments, when the first detected temperature T1 is lower than the first target temperature TP1, or when the second detected temperature T2 is lower than the second target temperature TP2, the first energizing processing and the second energizing processing are executed. Instead this, the first energizing processing to the first heater 83 and the second energizing processing to the second heater 84 may be executed only when the first detected temperature T1 is lower than the first target temperature TP1.

The second target temperature TP2 may be a value higher than the first target temperature TP1. The second temperature range W2 may also be a temperature range higher than the first temperature range W1.

The controller 10 may control energization of the first heater 83 and the second heater 84 by controls other than the phase control as the first energizing processing and the second energizing processing. The controller 10 may also control energization of the first heater 83 and the second heater 84 by an open control instead of controlling the energization of the first heater 83 and the second heater 84 by the feedback control. The first and second energizing processing can be executed by an external chip on the outside of the ASIC 11 or can be executed by the CPU 12 other than the heater controller 13, as long as the processing is executed by the controller 10.

The first temperature detector 87 has the non-contact type temperature sensor which is not in contact with the heating member 81, however, the present disclosure is not limited to this, and the first temperature detector 87 may have a contact type temperature sensor which is in contact with the heating member 81. It is also possible that the second temperature detector 88 may have a non-contact type temperature sensor which is not in contact with the heating member 81. Further, as mentioned above, the heating member 81 is a rotatable cylindrical-shaped roller, however, the present disclosure is not limited to this. The heating member may be an endless belt to be rotated and a nip forming member which causes the endless belt to be nipped between the pressure member 83 and the nip forming member. Furthermore, as mentioned above, the pressure member 82 may be an endless belt to be rotated and a nip forming member which causes the endless belt to be nipped between the heating member 81 and the nip forming member.

The printer 1 is not limited to the laser printer but may be a copier or a multifunction peripheral apparatus.

Respective elements explained in the above embodiments may be arbitrarily combined.

What is claimed is:

1. A fixing device, comprising:

a heating member configured to heat a sheet;

a first heater configured to heat a first area in the heating member;

a second heater configured to heat a second area which is a different area from the first area in the heating member;

a first temperature detector configured to detect a temperature of the first area;

a second temperature detector configured to detect a temperature of the second area; and a controller configured to execute a heating control in which the first heater is energized based on the temperature of the first area so that the temperature of the first area is within a first temperature range and the second heater is energized based on the temperature of the second area so that the temperature of the second area is within a second temperature range, wherein, in the heating control, the controller is configured to execute (i) a first energizing processing of energizing the first heater when the detected temperature of the second area is lower than a lower limit temperature in the second temperature range and the detected temperature of the first area is within the first temperature range, and (ii) a second energizing processing of energizing the second heater at the timing when the first energizing processing is stopped.

2. The fixing device according to claim 1, wherein, in the first energizing processing, the controller stops energization of the first heater when the detected temperature of the first area is higher than a first upper limit temperature which is an upper limit temperature in the first temperature range.

3. The fixing device according to claim 1, wherein, in the second energizing processing, the controller stops energization of the second heater when the detected temperature of the second area is higher than a second upper limit temperature which is an upper limit temperature in the second temperature range.

4. The fixing device according to claim 1, wherein, in the second energizing processing, the controller stops energization of the second heater after energizing the second heater for a predetermined energization period.

5. The fixing device according to claim 4, wherein the controller determines an energization period of the second heater in a current second energizing processing based on the temperature of the second area detected after execution of a previous second energizing processing.

6. The fixing device according to claim 1, wherein, in the second energizing processing, when the detected temperature of the second area is higher than a second upper limit temperature which is an upper limit temperature in the second temperature range, the controller stops energization of the second heater, and wherein, in the second energizing process, when the temperature of the second area detected after execution of a previous second energizing processing is equal to or higher than an overshoot temperature which is a higher temperature than the second upper limit temperature, the controller energizes the second heater for a predetermined energization period in a current second energizing processing.

7. The fixing device according to claim 1, wherein, in the second energizing processing, the controller stops energization of the second heater after energizing the second heater for a predetermined energization period, and wherein, in a case where the temperature of the second area detected after execution of a previous second energizing processing is lower than an undershoot temperature which is a lower temperature than the lower limit temperature in the second temperature range, the controller stops, in a current second energizing processing, energization of the second heater when the detected temperature of the second area is equal to or higher than a second upper limit temperature which is an upper limit temperature in the second temperature range.

8. The fixing device according to claim 1, wherein the controller does not execute the second energizing processing after executing the first energizing processing when the detected temperature of the first area is lower than the lower limit temperature in the first temperature range and the detected temperature of the second area is higher than a second upper limit temperature which is an upper limit temperature in the second temperature range, and wherein the controller executes the second energizing processing without executing the first energizing processing when the detected temperature of the second area is lower than the lower limit temperature in the second temperature range and the detected temperature of the first area is higher than a first upper limit temperature which is an upper limit temperature in the first temperature range.

9. The fixing device according to claim 1, wherein power consumption of the first heater is lower than that of the second heater.

10. The fixing device according to claim 1, wherein AC power is supplied to the first heater, and wherein the controller executes a phase control under a condition in which a duty ratio of energization of the first heater is less than 50% in the first energizing processing.

11. The fixing device according to claim 1, wherein the first area is a central part, of the heating member, in a width direction which is a direction parallel to a surface of the sheet conveyed in a conveying direction of the fixing device and intersecting the conveying direction, and wherein second areas each as the second area are opposite ends in the width direction with respect to the first area in the heating member.

12. The fixing device according to claim 11, wherein the first heater and the second heater are halogen heaters each having filaments configured to generate heat by energization, and the first heater and the second heater are disposed inside the heating member so as to extend in the width direction, wherein, in the first heater, a density of the filaments positioned in the first area is higher than a density of the filaments positioned in the second area, and wherein, in the second heater, a density of the filaments positioned in the second area is higher than a density of the filaments positioned in the first area.

13. The fixing device according to claim 1, wherein the controller controls the first area to be a first fixing temperature which is a target temperature and controls the second area to be a second fixing temperature which is a target temperature when the controller fixes a developer onto the sheet, and wherein a first upper limit temperature which is an upper limit temperature in the first temperature range is lower than the first fixing temperature, and a second upper limit temperature which is an upper limit temperature in the second temperature range is lower than the second fixing temperature.

14. The fixing device according to claim 1, wherein a response speed of the first temperature detector is higher than a response speed of the second temperature detector.

15. The fixing device according to claim 1, wherein the controller energizes the first heater without energizing the second heater in the first energizing processing, and energizes the second heater without energizing the first heater in the second energizing processing.

16. The fixing device according to claim 1, wherein the controller is configured to further execute the first energizing processing when the detected temperature of the first area is lower than the lower limit temperature in the first temperature range and the detected temperature of the second area is within the second temperature range, and the second energizing processing at the timing when the first energizing processing is stopped.

17. A method of controlling a fixing device including a heating member configured to heat a sheet, a first heater configured to heat a first area in the heating member, and a second heater configured to heat a second area which is an area different from the first area in the heating member, the method comprising a step of:

executing a heating control in which the first heater is energized based on a temperature of the first area so that the temperature of the first area is within a first temperature range and the second heater is energized based on a temperature of the second area so that the temperature of the second area is within a second temperature range, wherein, in the heating control, (i) a first energizing processing of energizing the first heater is executed when the detected temperature of the second area is lower than a lower limit temperature in the second temperature range and the detected temperature of the first area is within the first temperature range, and (ii) the second energizing processing of energizing the second heater is executed at the timing when the first energizing processing is stopped.

18. The method of controlling the fixing device according to claim 17, wherein the first energizing processing is executed when the detected temperature of the first area is lower than the lower limit temperature in the first temperature range and the detected temperature of the second area is within the second temperature range, and the second energizing processing is executed at the timing when the first energizing processing is stopped.

19. The method of controlling the fixing device according to claim 17, wherein, when the detected temperature of the first area is lower than the lower limit temperature in the first temperature range and the detected temperature of the second area is higher than a second upper limit temperature which is an upper limit temperature in the second temperature range, the second energizing processing is not executed after the first energizing processing is executed, and wherein, when the detected temperature of the second area is lower than the lower limit temperature in the second temperature range and the detected temperature of the first area is higher than a first upper limit temperature which is an upper limit temperature in the first temperature range, the second energizing processing is executed and the first energizing processing is not executed.

20. The method of controlling the fixing device according to claim 17, wherein AC power is supplied to the first heater, and wherein a phase control under a condition in which a duty ratio of energization of the first heater is less than 50% is executed in the first energizing processing.

* * * * *